US009047790B1

(12) United States Patent
Duderstadt

(10) Patent No.: US 9,047,790 B1
(45) Date of Patent: Jun. 2, 2015

(54) CARDHOLDER FOR PROTECTIVE HEADWEAR

(71) Applicant: James Louis Duderstadt, San Antonio, TX (US)

(72) Inventor: James Louis Duderstadt, San Antonio, TX (US)

( * ) Notice: Subject to any disclaimer, the term of this patent is extended or adjusted under 35 U.S.C. 154(b) by 0 days.

(21) Appl. No.: 13/968,322

(22) Filed: Aug. 15, 2013

Related U.S. Application Data

(63) Continuation-in-part of application No. 13/065,017, filed on Mar. 11, 2011.

(60) Provisional application No. 61/683,677, filed on Aug. 15, 2012, provisional application No. 61/390,152, filed on Oct. 5, 2010, provisional application No. 61/320,742, filed on Apr. 4, 2010.

(51) Int. Cl.

| | |
|---|---|
| ***G09F 3/00*** | (2006.01) |
| ***G09F 3/20*** | (2006.01) |
| *A42B 1/24* | (2006.01) |
| *G09F 21/02* | (2006.01) |
| *A47G 1/06* | (2006.01) |

(52) U.S. Cl.
CPC ..... *G09F 3/207* (2013.01); *A42B 1/248* (2013.01); *G09F 21/02* (2013.01); *A47G 1/0616* (2013.01)

(58) Field of Classification Search
USPC ..... 40/329, 732, 768, 650, 738
See application file for complete search history.

(56) References Cited

U.S. PATENT DOCUMENTS

| | | | | | |
|---|---|---|---|---|---|
| 836,481 | A | | 11/1906 | Brown | |
| 1,580,496 | A | | 4/1926 | Kelly | |
| 2,532,132 | A | * | 11/1950 | Vogel | 40/124.4 |
| 2,538,386 | A | * | 1/1951 | Schneider | 40/798 |
| 2,623,316 | A | * | 12/1952 | Knox | 40/799 |
| 2,839,857 | A | * | 6/1958 | Teller | 40/721 |
| 2,895,241 | A | | 7/1959 | Ferdinand et al. | |
| 2,935,804 | A | | 5/1960 | Duckro | |
| 3,438,062 | A | | 4/1969 | Dobell | |
| 3,846,925 | A | | 11/1974 | Busse | |
| 4,011,672 | A | | 3/1977 | Grusin | |
| 4,170,080 | A | * | 10/1979 | Bergh et al. | 40/732 |
| 4,667,274 | A | | 5/1987 | Daniel | |

(Continued)

FOREIGN PATENT DOCUMENTS

GB 2349327 A 11/2000

*Primary Examiner* — Shin Kim
(74) *Attorney, Agent, or Firm* — Kammer Browning PLLC

(57) ABSTRACT

Articles are provided that in some embodiments comprise a convex front face, a first slot disposed along the left of the face and a second slot disposed along the right of the face. Therein, articles are configured so that the slots can receive opposite edges of a rigid cardstock item, such as a personal identification card, the cardstock item being insertable into the articles and the slots being configured to hold a surface present on such a cardstock item so inserted to be in contact with, and mechanically biased towards, said front face. Articles in some embodiments provided are attachable to headwear using conventional means such as adhesives and any suitable conventional hardware. In other embodiments are provided headwear, including hardhats and bump hats, which incorporate features of the articles provided. Additional embodiments of an article which will hold an identification card or other rigid card stock in the vertical (or portrait) orientation as well as in the horizontal (or landscape) orientation. The article may be comprised of a single construct and mounted onto the outer shell of various headwear or the article may be incorporated directly into the outer shell of various headwear.

7 Claims, 8 Drawing Sheets

(56) References Cited

U.S. PATENT DOCUMENTS

| | | | | | |
|---|---|---|---|---|---|
| 4,967,499 | A | * | 11/1990 | Rosenberg | 40/732 |
| 5,189,822 | A | | 3/1993 | Schmanski et al. | |
| 5,276,985 | A | | 1/1994 | Halloran | |
| 5,452,479 | A | | 9/1995 | Mostert | |
| 5,687,496 | A | | 11/1997 | McEnroe | |
| 5,829,063 | A | | 11/1998 | Cheng | |
| 5,915,539 | A | | 6/1999 | Lack | |
| 6,032,394 | A | | 3/2000 | Hand et al. | |
| 6,076,295 | A | * | 6/2000 | Garfinkle | 40/605 |
| D445,262 | S | * | 7/2001 | Rowan | D6/300 |
| 6,293,038 | B1 | | 9/2001 | Chang | |
| 6,298,591 | B1 | | 10/2001 | Healy | |
| 6,625,913 | B1 | | 9/2003 | Prade | |
| 6,643,847 | B1 | | 11/2003 | Dornak | |
| 6,742,294 | B1 | | 6/2004 | Fossum | |
| 7,055,275 | B1 | * | 6/2006 | Teza et al. | 40/735 |
| 7,093,305 | B2 | | 8/2006 | Reilly et al. | |
| 7,117,621 | B2 | | 10/2006 | Chang | |
| D545,573 | S | * | 7/2007 | Vincent | D6/300 |
| 7,877,909 | B1 | | 2/2011 | Hagen et al. | |
| 8,104,208 | B2 | | 1/2012 | Schymura | |
| 2006/0272189 | A1 | | 12/2006 | Cummings et al. | |
| 2008/0172776 | A1 | | 7/2008 | Webster | |

* cited by examiner

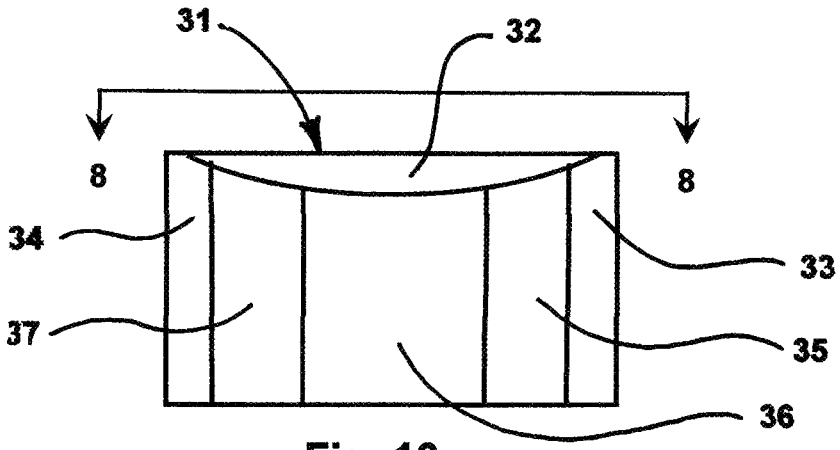
Fig. 16
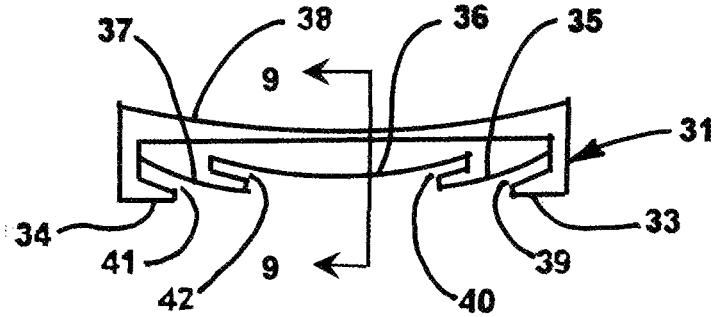
Fig. 17 (View 8-8)
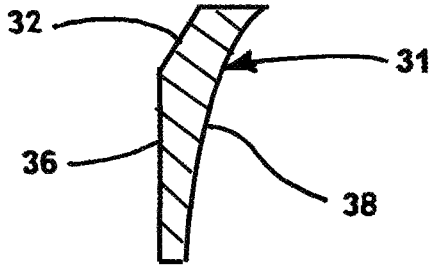
Fig. 18 ( Section 9-9)

CARDHOLDER FOR PROTECTIVE HEADWEAR

CROSS REFERENCES TO RELATED APPLICATIONS

This application claims benefit under Title 35 United States Code §119(e) of U.S. Provisional Patent Application Ser. No. 61/683,677, filed Aug. 15, 2012; and further claims benefit under Title 35 United States Code §120 as a Continuation-In-Part of co-pending U.S. patent application Ser. No. 13/065,017, filed Mar. 11, 2011; which itself further claims benefit under Title 35 United States Code §119(e) of U.S. Provisional Patent Application Ser. No. 61/390,152, filed Oct. 5, 2010, and U.S. Provisional Patent Application Ser. No. 61/320,742, filed Apr. 4, 2010, the full disclosures of which are each incorporated herein by reference.

FIELD OF THE INVENTION

This invention relates generally to personnel identification, worksite security, and protective headwear. More particularly, it relates to protective headwear such as hard hats and bump caps that are configured (or adapted) to removably receive a personal identification card of the wearer of the head wear, in some embodiments.

DESCRIPTION OF THE RELATED ART

It is common at various worksites and facilities for personnel to wear protective headwear and produce some form of personal identification prior to being admitted to the worksite or facility. Historically, plant personnel and the like are frequently provided with identification cards attached to lanyards, clips or other hardware that enables the person to wear their identification card around their neck, or clipped to an article of clothing. Identification information so displayed, such as an identification card, is then readily visible to security personnel charged with site security to assist security personnel in ensuring that only authorized personnel are admitted to a work area or worksite.

However, in many instances it may not be desirable or most efficacious to employ conventional methods and wares for displaying identification information.

SUMMARY OF THE INVENTION

Articles useful for receiving and holding a rigid cardstock item having opposite edges, comprising in some embodiments a substantially rectangular solid having a front face, a rear face, an upper portion, a lower portion, a right side, and a left side. The front face includes a convex surface and the rear face includes a concave surface. There is a first slot disposed substantially along the left side of the article, and a second slot disposed substantially along the right side of the article. The slots are configured to receive the edges of and to hold a surface present on a rigid cardstock item in contact with, and mechanically biased towards, the front face.

Also provided is headwear comprising a shell. The headwear further comprises, attached to the shell, and alternately in some embodiments integral to the head wear, provision for receiving and holding a rigid cardstock item having opposite edges. In some embodiments the provision comprises a front face having a convex surface, and there is a first slot disposed substantially along a first portion of the face, and a second slot disposed substantially along a second portion of the face. The slots are configured to receive the edges and to hold a surface present on the rigid cardstock item in contact with, and mechanically biased towards, the front face. In some embodiments the slots are parallel to one another and spaced from one another a distance that is slightly less than opposite parallel edges present on a rigid card stock item, which in cooperation with the convex surface, is the source of the mechanical bias.

BRIEF DESCRIPTION OF THE DRAWINGS

Embodiments of the invention may take physical form in certain parts and arrangement of parts, the preferred embodiment of which will be described in detail and illustrated in the accompanying drawings which form a part hereof, and wherein:

FIG. 16 is a front view of an article according to some embodiments of the disclosure.

FIG. 17 is an overhead view of an article according to some embodiments of the disclosure.

FIG. 18 is a sectional view of an article according to some embodiments of the disclosure.

DETAILED DESCRIPTION OF THE PREFERRED EMBODIMENTS

Figure 1A:
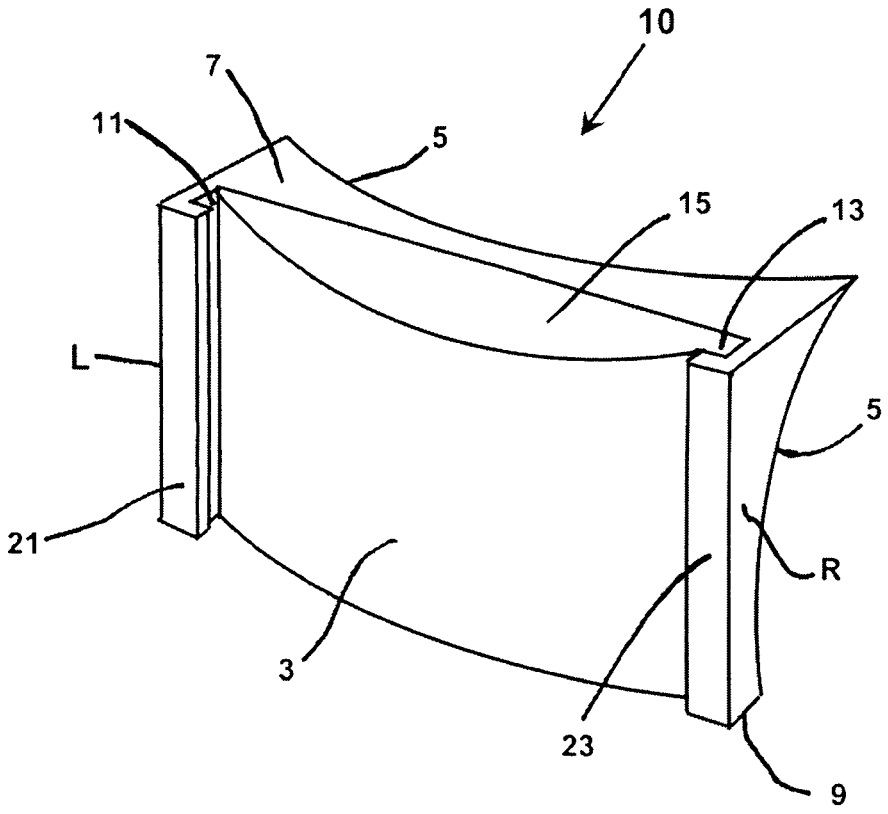
FIG. 1A is a front perspective view of an article according to some embodiments of the disclosure.

Referring now to the drawings, wherein the showings are provided for the purpose of illustrating the invention only and not for the purpose of limiting the same, FIG. 1A shows a front perspective view of an article 10 according to some embodiments of the disclosure. In FIG. 1A there are illustrated the locations of front face 3, beveled edge 15, rear face 5, upper portion 7, lower portion 9, left side L, and right side R. Also shown in FIG. 1A are slot 11 and slot 13, each having an open portion at the upper portion 7 of article 10. Slots 11, 13 can be either open or closed at lower portion 9. In general, slots 11, 13 are each configured to receive and retain opposite edges of a rigid cardstock item, which cardstock item can include without limitation articles of personal identification such as driver's license cards, credit cards, employer-issued identification cards, and like articles. Many such cardstock items are rectangular in shape and have opposite sides which are parallel to one another, along the item's short side, when not square. Slots 11, 13 are in some embodiments defined by the presence of retainers 21, 23. The retainers can be any feature that defines slots 11, 13, or functionally-equivalent features, that are capable of cooperatively functioning with a convex surface on front face 3 to hold the cardstock item in place as described herein.

In some embodiments, article 10 is comprised of a single construct, i.e. article 10 is a single piece of injected molded plastic, and retainers 21, 23 are an integral (cast-in) feature of article 10. Retainers 21, 23 in some embodiments are just bars of material cast-in to article 10, and function as guides present at the left side L and right side R of article 10, which guides in some embodiments run the entire sides of article 10 from upper portion 7 to lower portion 9 as shown in FIG. 1A. In other embodiments, any selected portions or segments of retainers 21, 23 can be omitted, provided that enough retainer material is present to enable article 10 to function as herein described.

In some embodiments, front face 3 is contoured to be a convex surface. In some embodiments only a selected portion of front face 3 is contoured to be a convex surface, the selected portion being oriented about the center of front face 3. Slots 11, 13 function cooperatively with front face 3 when convex, to rigidly maintain an identification card (or other rigid cardstock) in place within article 10, particularly when an identification card is positioned with two of its opposite edges into slots 11, 13, and subsequently pushed or slid completely into slots 11, 13 so that the identification card becomes substantially-centered on front face 3, two of its opposite edges being present in slots 11, 13 and wherein the surface of the identification card that is disposed towards front face 3 is in contact with front face 3. In some embodiments, slots 11, 13 are selected to be spaced or positioned from one another a distance that is slightly less than the distance between the opposite edges of a rigid cardstock item that is to be held in article 10, in order to cause the rigid cardstock item to be slightly flexed, causing a mechanical bias due to the cardstock item functioning akin to a spring, i.e., a tiny amount of potential energy is caused to be present in the cardstock item by virtue of flexing caused by the spacing between the slots 11, 13 being less than the dimension of the cardstock item. In other embodiments, slots 11, 13 are selected to be spaced or positioned from one another a distance that is slightly greater than the distance between the opposite edges of a rigid cardstock item that is to be held in article 10. In other embodiments slots 11, 13 are selected to be spaced or positioned from one another a distance that is about the same as (and optionally the same as) the distance between the opposite edges of a rigid cardstock item that is to be held in article 10.

Figure 1B:
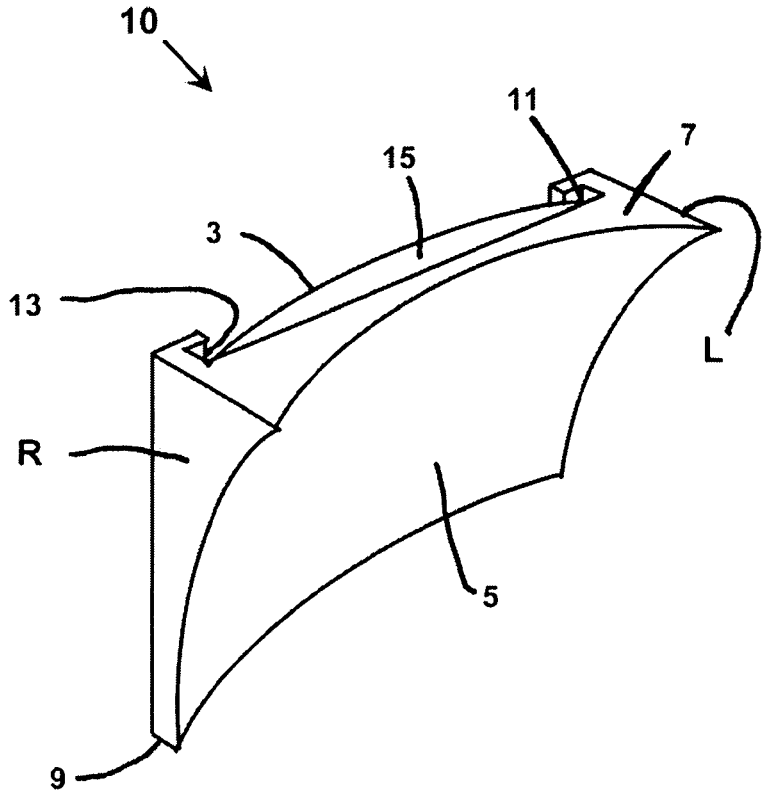
FIG. 1B is a rear perspective view of an article according to some embodiments of the disclosure.

FIG. 1B shows a rear perspective view of an article 10 according to some embodiments of the disclosure. In this FIG. 1B are shown the respective locations of front face 3, rear face 5, upper portion 7, lower portion 9, left side L, and right side R. Also shown is beveled surface 15.

Figure 2:
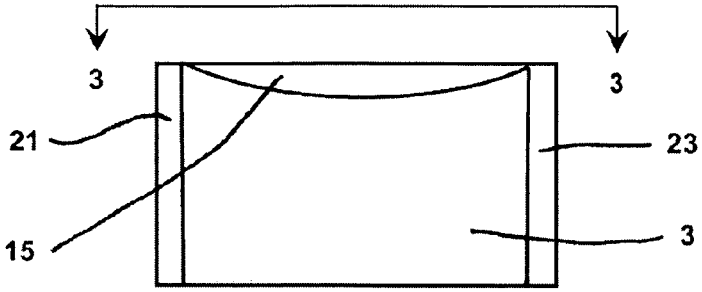
FIG. 2 is a front view of an article according to some embodiments of the disclosure.

FIG. 2 is a front view of an article 10 according to some embodiments of the disclosure, showing the respective locations of front surface 3, retainer 21, retainer 23, as well as beveled surface 15.

Figure 3:
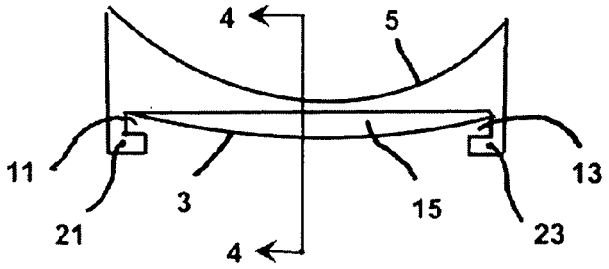
FIG. 3 is an overhead view of an article according to some embodiments of the disclosure.
Figure 8:
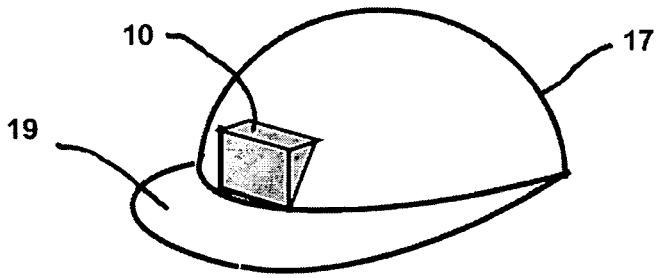
FIG. 8 is a perspective view of an article according to some embodiments of the disclosure in combination with headwear.
Figure 9:
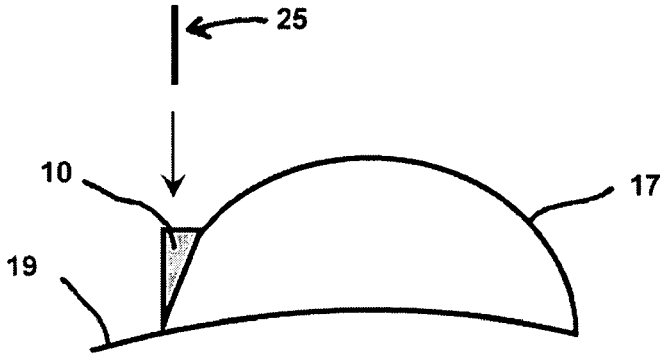
FIG. 9 is a side view of an article according to some embodiments of the disclosure in combination with headwear.
Figure 10:
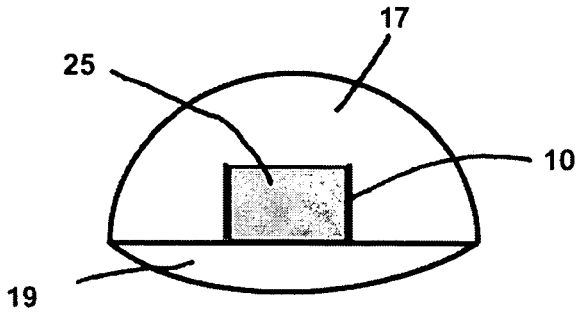
FIG. 10 is a front view of an article according to some embodiments of the disclosure in combination with headwear.

FIG. 3 is an overhead view of an article 10 according to some embodiments of the disclosure, showing slots 11, 13 into which an identification card is inserted into article 10. Convex front face 3 is disposed between the slots 11, 13, which causes an inserted identification card to become flexed after insertion into slots 11, 13, thereby creating a frictional engagement between a surface on the identification card and front face 3 sufficient to maintain the identification card in a stationary position within article 10. In some embodiments slots 11, 13 present along, adjacent to, and parallel with the left and right side edges of article 10 are configured to receive and hold a rigid cardstock item so that the rigid card stock item is in contact with, and mechanically biased towards front face 3, sufficiently to maintain the cardstock item in place within article 10. In some embodiments slots 11, 13 are parallel to one another in order to accommodate the receipt of a cardstock item which itself has opposite edges that are parallel to one another. In some embodiments, slots 11, 13 are mirror-images of one another, the mirror plane being section 4-4 of FIG. 3. The embodiment of FIG. 4 also shows rear face 5 is contoured to substantially match the contour of an article of headwear to which article 10 is to be attached, as depicted in FIGS. 8, 9, 10.

An article as provided has an overall configuration that means that no additional covers, clips, or retaining wares are required to hold an identification card in place in article 10, as is necessitated by articles of the prior art. Moreover, an article 10 according to the disclosure does not require any bumps, tabs, lugs, protrusions, holes or other features or indentations to be present in or on an article 10 according to the disclosure, or the rigid cardstock item in order for the rigid cardstock item to be maintained in a stationary position in article 10.

Figure 4:
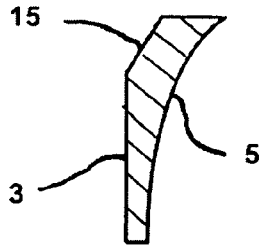
FIG. 4 is a section view of an article according to some embodiments of the disclosure.

FIG. 4 is a section view of an article 10 according to some embodiments of the disclosure from the section 4-4 of FIG. 3. Beveled surface 15 is shown disposed at the upper portion of front face 3 and facilitates (guides) an identification card or the like to be easily inserted down into slots 11, 13 (FIG. 3) without the need for pre-bending of the identification card by the user. That is, the features of article 10 are sufficient to cause a slight bending or flexing of a rigid cardstock item (25, FIG. 9) when inserted into article 10 without the user consciously bending or flexing the cardstock item. This is of advantage in instances where personnel are required to quickly remove and replace their identification cards for processing through a time clock or security monitor as they enter or exit a facility. Rear face 5 is contoured to coincide with the exterior contour of any selected portion of an article of head wear, such as a hard hat or bump cap.

Figure 5:
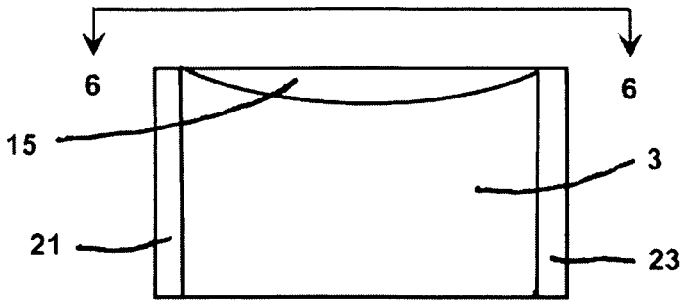
FIG. 5 is a front view of an article according to some embodiments of the disclosure.

FIG. 5 is a front view of an article 10 according to some embodiments of the disclosure when the article 10 is affixed to an article of headwear. The respective locations of retainers 21, 23 are shown, as well as front face 3 and beveled surface 15.

Figure 6:
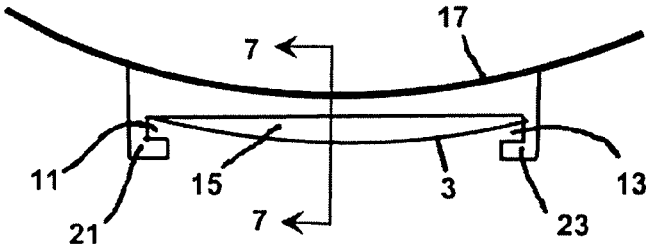
FIG. 6 is an overhead view of an article according to some embodiments of the disclosure.

FIG. 6 is an overhead view of an article 10 according to some embodiments of the disclosure in which the article 10 is integrally moulded with an article of head wear. That is, moulds for the manufacture of head wear (including hardhats and bump caps) can be provided so that a finished moulded article of head wear includes an article 10, and in optional embodiments a sub-set of features thereof, as provided herein as an integral part of the headwear, i.e., the article 10 and headwear collectively comprise a one-piece, single construct. In such embodiment, the shell 17 of the headwear is shown, as well as slots 11, 13, front face 3, as well as beveled surface 15.

Figure 7:
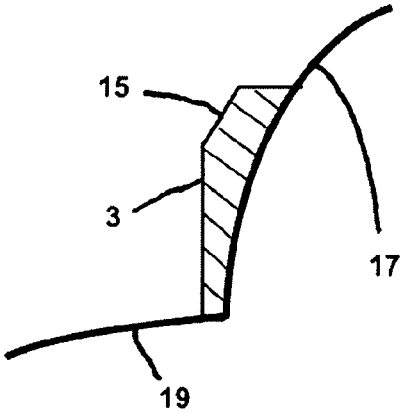
FIG. 7 is a section view of an article according to some embodiments of the disclosure.

FIG. 7 is a section view of an article 10 according to some embodiments of the disclosure, taken through the section 7-7 of FIG. 6 and showing the respective locations of front face 3, beveled surface 15, headwear shell 17, and the front bill 19 of the headwear article, the front bill 19 being analogous to a visor.

FIG. 8 is a perspective view of an article 10 according to some embodiments of the disclosure in combination with headwear. The headwear shown, as most in the art, has an outer shell 17, and at least a front bill 19. FIG. 8 shows how an article 10 is combined with an article of head wear, which can be accomplished as already mentioned by moulding article 10 to be integral with the head wear during its time of manufacture, such as by an injection moulding, blow moulding, or other selected known moulding process. In alternate embodiments, an adhesive material is applied to rear face 5 at any selected location, and article 10 when free-standing, such as the embodiments shown in FIGS. 1A and 1B, is attached to headwear by contacting the adhesive material disposed on rear face 5 of article 10 with the shell 17 of the head wear sufficient for adhesion of article 10 to the headwear. The adhesive material is any known adhesive, including without limitation rubber cements, superglues, and two-sided adhesive tape. In other embodiments, conventional fasteners are employed to affix an article 10 according to the disclosure to an article of head wear, which fasteners include without limitation: screws, nuts and bolts, and rivets.

FIG. 9 is a side view of an article 10 according to some embodiments of the disclosure in combination with headwear, which can be the free-standing embodiment of FIGS. 1A and 1B affixed to the headwear by means of an adhesive material, or also as being a single construct with the headwear. This view illustrates how a rigid cardstock item 25 (which in some embodiments is an identification card) is readily inserted into article 10 or headwear comprising same, in the direction of the arrow into the slots 11, 13 present on article 10.

FIG. 10 is a front view of an article 10 according to some embodiments of the disclosure in combination with headwear including the embodiments shown and described in relation to FIGS. 8 and 9. The respective locations of article 10, shell 17 and bill 19 are shown.

Figure 11:
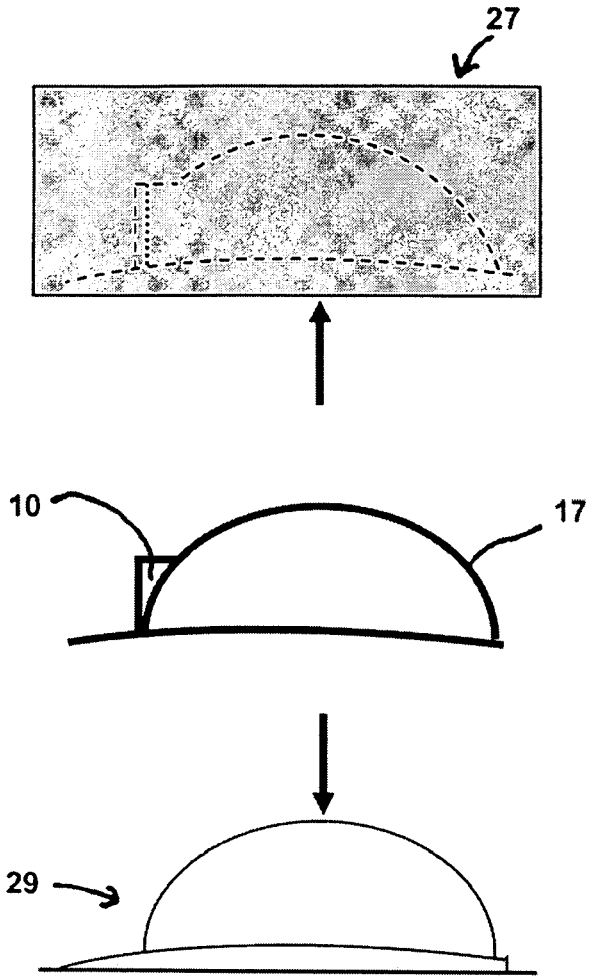
FIG. 11 is a side view of an article according to some embodiments of the disclosure.

FIG. 11 is a side view of an article 10 according to some embodiments of the disclosure present on an article of headwear having a shell 17, wherein article 10 is an integral part of the headwear article, having been manufactured in a moulding process that utilizes an outer or top mould 27, and an inner or bottom mould 29. In some embodiments, the top mould 27 and bottom mould 29 are held in proximity to one another and molten thermoplastic material is injected into the mould cavity formed thereby. Once the resin used in making the head wear item has hardened such as by cooling, the top mould 27 and bottom mould 29 portions are withdrawn from one another, thus yielding the headwear article having article 10 as an integral component thereof. In some embodiments, the top mould 27 is configured so that the mould features which define slots 11, 13 present on the headwear article so made are oriented to be parallel to the direction of separation of the top mould 27 from the bottom mould 29 during the manufacturing process, after the headwear has been formed. Such mould configuration permits two, four, or even more slots oriented as shown and described to be present in a single article 10 according to the disclosure, which would provide for identification cards and other rigid cardstock of various sizes to be contained in either a landscape or portrait position by merely altering the spacing between the slots during the mould-making process. A configuration as shown and described herein has advantage over like articles of the prior art which have slots that are oriented horizontally (as opposed to the vertically oriented slots of this disclosure) in that articles with such horizontally-oriented slots would be difficult to manufacture by an injection moulding process because the slots are perpendicular to the direction in which the moulds are pulled apart once the headwear containing article 10, or article 10, is formed.

Suitable materials of construction of an article 10 according to the disclosure, and headwear that includes an article 10 as an integral part of its construction include polymeric materials, as are known in the art for headwear such as hardhats and bump caps. For some embodiments, article 10 can be thought of as being comprised of a substantially-rectangular shaped solid of polymeric material having various features shown and described herein. Suitable polymeric materials include thermoset resins, thermoplastic resins, and composite materials. Polyolefins and blends containing polyolefins are suitable. In some embodiments polypropylene is employed. In some embodiments polyethylene is employed. Any material known to be suitable is sufficient to provide an article 10 according to the disclosure, or headwear that incorporates same into its construction, provided where relevant that the material is capable of meeting or exceeding the standards of ANSI Z89.1. Metals such as aluminum and any other known metallic alloys are also suitable materials of construction of an article 10 according to some embodiments of the disclosure. Generally, protective headwear for industrial workers which complies with ANSI Z89.1 is called a "hard hat" and protective headwear which does not comply with ANSI Z89.1 is called a "bump cap". The present disclosure provides embodiments having the features of article 10 present on both bump caps and hard hats, some embodiments having article 10 attached to a headwear article (including either hard hat or bump cap), and some embodiments in which the headwear article is made to include cooperatively functional features of article 10 as part of its construction when the headwear is a single-moulded article (of unitary construction).

One advantage of the use of an article 10 according to the disclosure is that it enables security personnel to quickly identify intruders or unauthorized personnel within the premises because such persons would not have an identification card displayed on their hard hats or bump caps.

Another advantage of the use of an article 10 according to the disclosure is that supervisors and managers are more able to quickly identify various personnel such as welders, subcontractors or visitors, since this information could be placed on their identification cards which would be clearly displayed on their hard hats or bump caps.

Another advantage of the use of an article 10 according to the disclosure is that would improve control and distribution over tools and materials which are issued to various personnel within a facility because their identities would be clearly visible and easily recorded.

Another advantage of the use of an article 10 according to the disclosure is that it would help reduce loss or misplacement of identification cards, yet also allow personnel to easily remove their identification cards upon leaving the facility for processing thru a time clock or for retention by security personnel.

Another advantage of the use of an article 10 according to the disclosure is that emergency response could also be improved when medical and other critical information is present on a persons' identification card in article 10, which information is then readily found on their hard hat or bump cap.

Another advantage of the use of an article 10 according to the disclosure is that it is far safer to utilize an article 10 on a hard hat rather than utilize a card holder attached to a lanyard, owing to the possibility that a lanyard may become entangled in power tools or rotating equipment.

In some embodiments, the rigid cardstock item has an implement attached to it, which implement can be selected from, without limitation: lights, lamps, and cameras. This provides a wearer of head wear having features as herein described with the ability to utilize such implements without the use of their hands. In such embodiments, the implement is attached to a rigid cardstock item that is not necessarily an identification card, but is a blank piece of rigid material that can be inserted into slots 11, 13 to maintain the implement securely on the headwear.

Moreover, an article 10 as provided in some embodiments does not need an accessory slot, and can be configured to fit on any hard hat or bump cap, unlike some articles of the prior art that can only be fitted into an accessory slot on the side of the hard hat.

Figure 14:
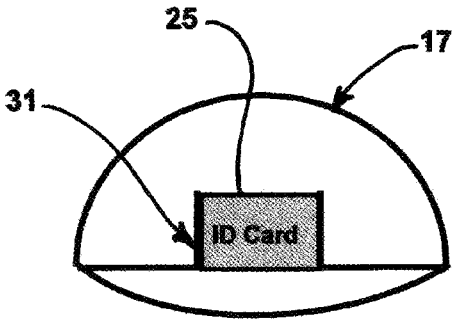
FIG. 14 is a front view of an article according to some embodiments of the disclosure in combination with headwear.
Figure 15:
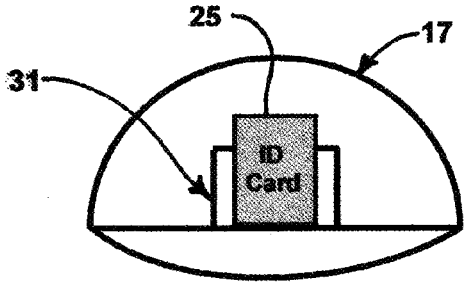
FIG. 15 is a front view of an article according to some embodiments of the disclosure in combination with headwear.

In some embodiments, article 31 which holds a rectangular rigid card stock 25 may include multiple vertical slots 39, 40, 41 & 42 to allow a rectangular rigid card stock item 25 to be placed in the vertical (or portrait) orientation as shown in FIG. 15, in addition to the horizontal (or landscape) orientation as shown in FIG. 14.

Figure 12:
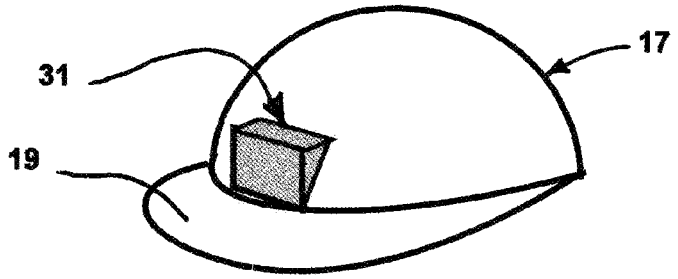
FIG. 12 is a perspective view of an article according to some embodiments of the disclosure in combination with headwear.

FIG. 12 is a perspective view of article 31 in combination with headwear, according to some embodiments of the disclosure, showing how article 31 may also be positioned and combined with outer shell 17 of said headwear in the same manner as previously described above and as previously shown in FIG. 8.

Figure 13:
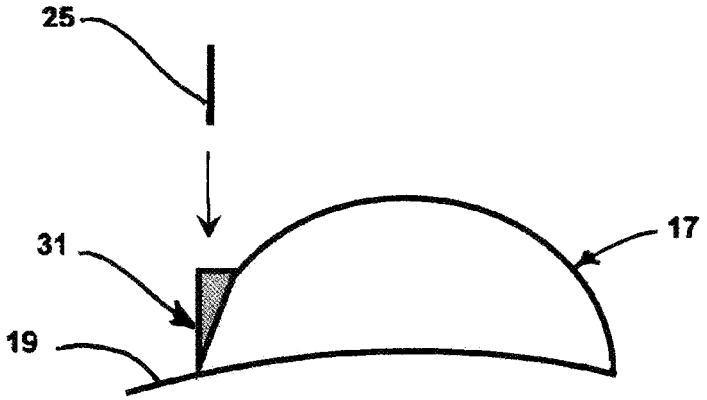
FIG. 13 is a side view of an article according to some embodiments of the disclosure in combination with headwear.

FIG. 13 is a side view of article 31, in combination with headwear, showing how rigid card stock 25 may be inserted into article 31 in the same manner as previously described above and as previously shown in FIG. 9.

FIGS. 14 and 15 are front views of article 31, in combination with headwear, showing how rigid card stock 25 may be held by article 31 in the horizontal (or landscape) orientation as shown in FIG. 14 or in the vertical (or portrait) orientation as shown in FIG. 15.

FIG. 16 is a front view of article 31, according to some embodiments of the disclosure, showing the respective locations of bevel 32, retainer 33, retainer 34, curved surface 35, curved surface 36 and curved surface 37.

FIG. 17 is an overhead view (8-8) of article 31, according to some embodiments of the disclosure, showing slots 39 and 41 into which a rectangular rigid card stock item 25 may be placed in the horizontal (or landscape) orientation. Curved surfaces 35 and 37 will bend rigid card stock 25 against retainers 33 and 34, thereby creating sufficient friction between rigid card stock 25 and curved surfaces 35 and 37 to hold rigid card stock 25 in place. Article 31 also includes slots 40 and 42 into which a rectangular rigid card stock 25 may be placed in the vertical (or portrait) orientation. When card stock 25 is placed into slots 40 and 42, curved surface 36 will bend card stock 25, thereby creating sufficient friction between card stock 25 and curved surface 36 to hold card stock 25 in place.

FIG. 18 is a sectional view (9-9) of article 31 showing beveled surface 32 and curved surface 36 on the front side of article 31 and curved surface 38 on the back side of article 31. Note that curved surface 38 is contoured to fit closely on outer shell 17 of aforementioned headwear to allow article 31 to be securely fastened to outer shell 17 of the aforementioned headwear, as previously described above.

In some embodiments of the disclosure, article 31 may also be moulded directly into outer shell 17 of said headwear as previously described above.

Consideration must be given to the fact that although this invention has been described and disclosed in relation to certain preferred embodiments, equivalent modification and alterations thereof may become apparent to persons of ordinary skill in this art after reading and understanding the teachings of this specification, drawings, and the claims appended hereto. The present disclosure includes subject matter defined by any combinations of any one or more than one of the features provided in this disclosure with any one or more than one of any other features provided in this disclosure. These combinations include the incorporation of the features and/or limitations of any dependent claim, singly or in combination with features and/or limitations any one or more of the other dependent claims, with features and/or limitations of any one or more than one of the independent claims, with the remaining dependent claims in their original text being read and applied to any independent clams so modified. These combinations also include combination of the features and/or limitations of one or more than one of the independent claims with features and/or limitations of another independent claim to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures, being limited only by the scope of the claims which follow.

I claim:

1. A card holder useful for placement on a rigid article of headwear, for receiving and holding a rigid cardstock item, the rigid cardstock item having a first set of opposite parallel edges and a second set of opposite parallel edges generally orthogonal to the first set, the card holder comprising a substantially-rectangular solid having a front face to be oriented outward from the article of headwear, a rear face to be oriented inward towards the article of headwear, an upper portion, a lower portion, a first opposing side, a second opposing side, and a center line;

said front face including a convex surface bowed outward in a middle region between the first and second opposing sides of the rectangular solid;

said rear face including a concave surface contoured as a depression curving inward top to bottom and side to side so as to be received on and make contact with the domed contour the article of headwear;

a first slot disposed on said front face substantially along adjacent and parallel with said second opposing side;

a second slot disposed on said front face substantially along adjacent and parallel with said first opposing side;

a third slot disposed on said front face, adjacent and parallel with the first slot but spaced towards the center line therefrom;

a fourth slot disposed on said front face, adjacent and parallel with the second slot but spaced towards the center line therefrom;

said first and second slots being configured to receive the first set of opposite parallel edges, said third and fourth slots being configured to receive the second set of opposite parallel edges, said slots positioned in pairs to hold a surface present on the rigid cardstock item in contact with, and mechanically biased towards, said front face.

2. The card holder of claim 1 wherein said front face further comprises a beveled surface portion proximate to the upper portion of the card holder, the beveled surface providing a guide surface for insertion of the rigid cardstock item.

3. The card holder of claim 1 wherein said rigid cardstock item is a person's identification card.

4. The card holder of claim 1, further comprising an adhesive material present on said rear face.

5. The card holder of claim 1 wherein said first and second slots are oriented to be parallel to each other and said third and fourth slots are oriented to be parallel to each other.

6. The card holder of claim 5 wherein a distance between said first and second slots is greater than a distance between said third and fourth slots.

7. The card holder of claim 1 wherein each of the slots is open on an end adjacent the upper portion of the holder and closed on an end adjacent the lower portion of the holder.

* * * * *